United States Patent [19]

Potts

[11] 4,160,803

[45] Jul. 10, 1979

[54] SELF PACKAGED TEST KIT

[75] Inventor: Robert S. Potts, Sherborn, Mass.

[73] Assignee: Corning Glass Works, Corning, N.Y.

[21] Appl. No.: 889,218

[22] Filed: Mar. 23, 1978

[51] Int. Cl.[2] ..... B01L 9/00

[52] U.S. Cl. ..... 422/101; 422/61; 422/102; 422/104; 206/509; 206/511; 220/23.6

[58] Field of Search ..... 23/292, 259; 206/443, 206/509, 511; 220/23.4, 23.6; 211/74; 248/176

[56] References Cited

U.S. PATENT DOCUMENTS

| | | | |
|---|---|---|---|
| 3,106,845 | 10/1963 | Dimmick | 23/292 X |
| 3,215,500 | 11/1965 | Bittner | 23/292 X |
| 3,319,792 | 5/1967 | Leder et al. | 23/292 X |
| 3,647,105 | 3/1972 | Kesslar | 206/443 X |
| 3,785,928 | 1/1974 | Kesslar | 23/292 X |
| 3,796,552 | 3/1974 | Robinson | 23/292 |
| 3,889,416 | 6/1975 | Bergeron et al. | 211/74 X |
| 3,940,249 | 2/1976 | McClurg | 23/292 X |
| 4,003,713 | 1/1977 | Bowser | 23/259 X |
| 4,008,810 | 2/1977 | Merz | 211/74 X |
| 4,058,370 | 11/1977 | Suovaniemi et al. | 23/259 |

*Primary Examiner*—Morris O. Wolk
*Assistant Examiner*—Michael S. Marcus
*Attorney, Agent, or Firm*—John P. DeLuca; Burton R. Turner

[57] ABSTRACT

A self-packaged structure for use as a test kit for convenient handling of the component parts of the kit as a modular unit. The structure is designed such that tests may be carried out using certain components to effect semi-automatic collection of chemical or biochemical fractions in tubes. The fractions result from allowing a liquid sample to flow through a column which contains support media. The components of the structure include, rack structures which are adapted to package the columns and tubes in a stackable array and a tray adapted to secure the rack structures in a group.

22 Claims, 16 Drawing Figures

Fig. 9a
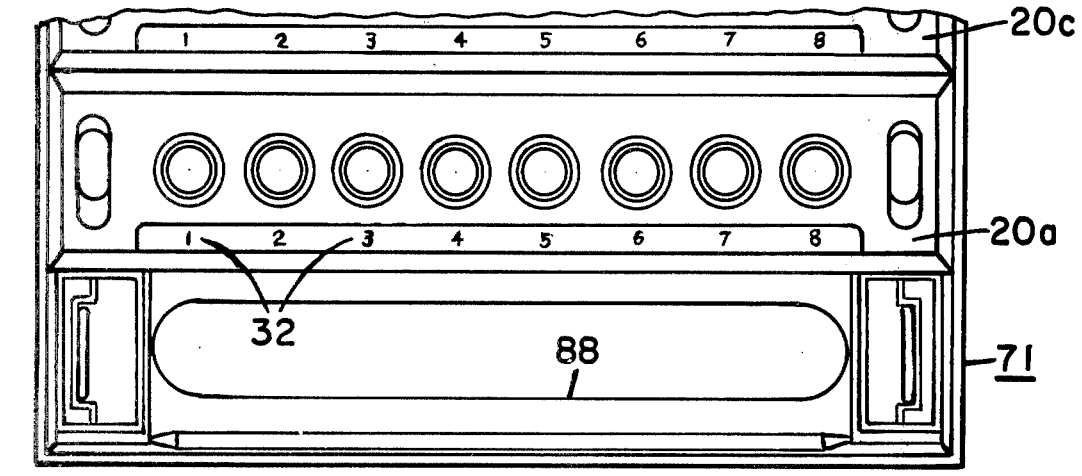
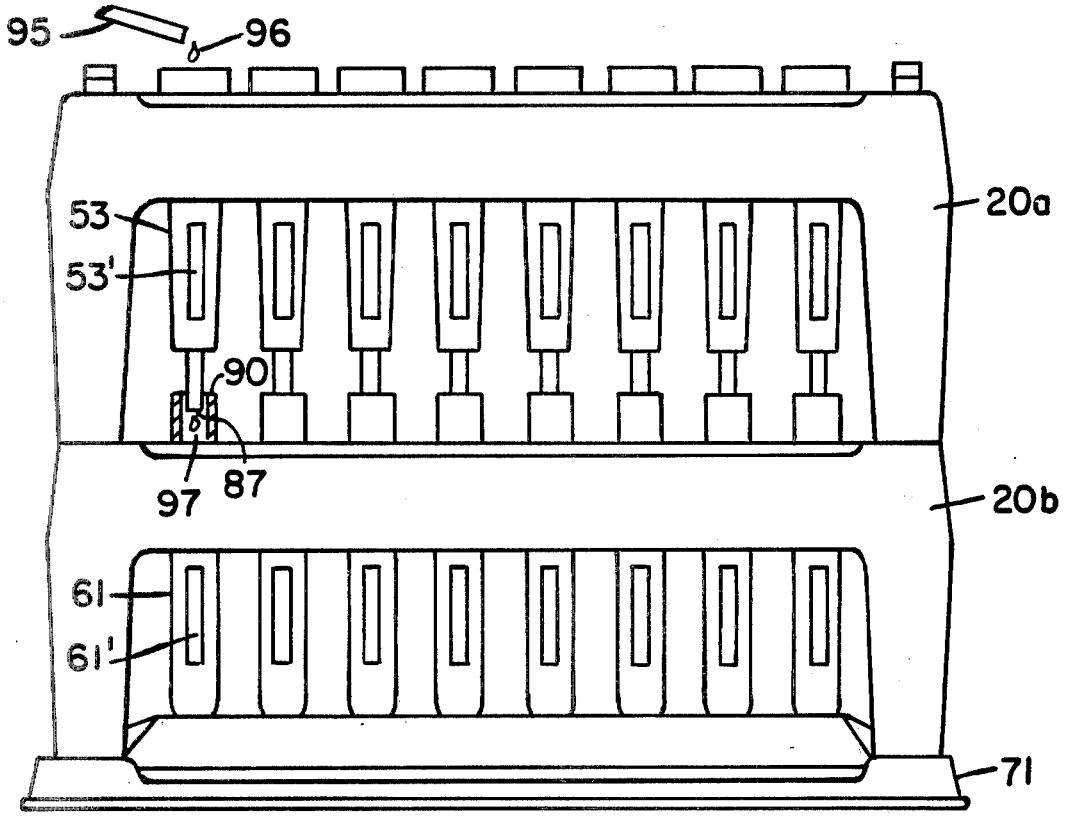
Fig. 9b

SELF PACKAGED TEST KIT

BACKGROUND OF THE INVENTION

This invention relates to modular structures adapted to be used as test kits and components therefor, and particularly to a system of components, which is adapted for shipment of equipment in modular stackable packages, and which packages, by their configuration, serve to reduce unnecessary handling of the test equipment and simplify the processes of carrying out the tests.

In a process of collecting reagent fractions in a collection tube, which result from allowing a liquid reagent sample to flow through a column containing support media, columns and tubes are normally shipped to the user in containers which are useful only for storage. The tubes and columns, hereinafter generally referred to as the equipment, may be in containers having recesses for receiving the individual items or may be merely packaged in counted bundles within a box. For each test or group of tests a technician must retrieve the tubes and columns as required and arrange same in test tube racks in an orderly fashion with appropriate identification. The columns may be shipped without regard for orientation, which can cause difficulties with support media function. The columns are normally charged with an inert buffer solution to prolong shelf life and sideways or horizontal orientation may result in partial drying or exposure of the media, as a result a condition known as channeling, whereby the medium does not properly fraction reagent samples occurs (i.e. the reagent may "run through" the media without fractioning).

In addition to the foregoing, present practice requires that each test or sample be carried out manually, requiring handling of each fraction column and collection tube numerous times for identification and sampling. Consequently test execution times are increased, the possibility of error exists to a greater extent and laboratory operation may be less efficient than desired.

It is therefore intended, by the disclosure of the present invention, to obviate some of the shortcomings and difficulties of the described prior arrangements.

DESCRIPTION OF THE DRAWINGS

FIGS. 9*a* and 9*b* are a fragmental top plan view and a front elevational view, respectively, of a test kit as is used in carrying out tests in accordance with principles of the present invention.

SUMMARY OF INVENTION

There has been provided a self-packaged structure for use as a test kit for handling and carrying out tests utilizing collection tubes and fraction columns wherein, a plurality of modular laboratory racks are adapted for supporting fraction columns and test tubes, and means is adapted for securing one rack adjacent to the other to form the test kit as a package. Each rack comprises a modular integral monolith including dependent legs, and a horizontal support member joining upper portions of the legs. The support member has a plurality of through holes therein aligned adjacent one another between the legs, which holes are adapted to receive the columns and tubes in substantially upright fashion. Upstanding lugs are disposed on an upper surface of the support member and are aligned with a lower horizontal support surface of the legs. The legs, on the other hand, have complimentary recesses in lower facing support surfaces thereof shaped for frictionally receiving the lugs of another of said racks to facilitate stacking of one rack over another.

In one embodiment the means for securing one rack adjacent another includes a tray structure having formed upper and lower surfaces adapted to mate with respective complimentary recesses in the lower support surfaces of the legs and the upstanding lugs on the upper surface of the support member.

DESCRIPTION OF THE PREFERRED EMBODIMENT

Figure 1:
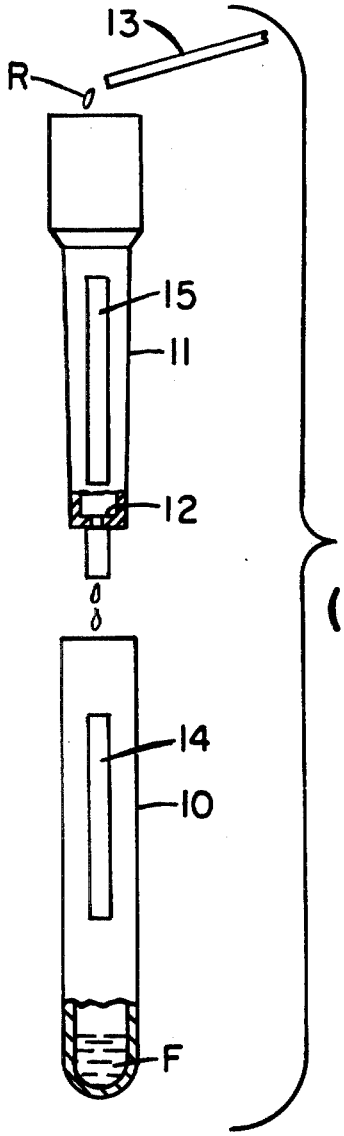
Fig. 1 (PRIOR ART)
FIG. 1 is an illustration of a typical prior art test procedure.

In FIG. 1 there is illustrated a typical arrangement utilized in the prior art, including a tube 10 of conventional design which collects a fraction F therein. The fraction F is delivered to the tube 10 from a fraction column 11, which has a support media 12 secured therein. A chemical or biochemical reagent R is delivered to the column 11 by use of pipette 13, and said reagent R reacts with the media 12 such that a fraction F is delivered to tube 10. The tube 10 and column 11 are typically retrieved from a respective box of tubes and columns (not shown), and held manually or by clamps or test tube racks, (also not shown), each tube 10 and column 11 is identified individually for each sample by a respective identification label 14 and 15.

The arrangement of FIG. 1 is inconvenient to implement a rapid and accurate test procedure, since excessive handling and manipulation of the components are required.

Figure 2:
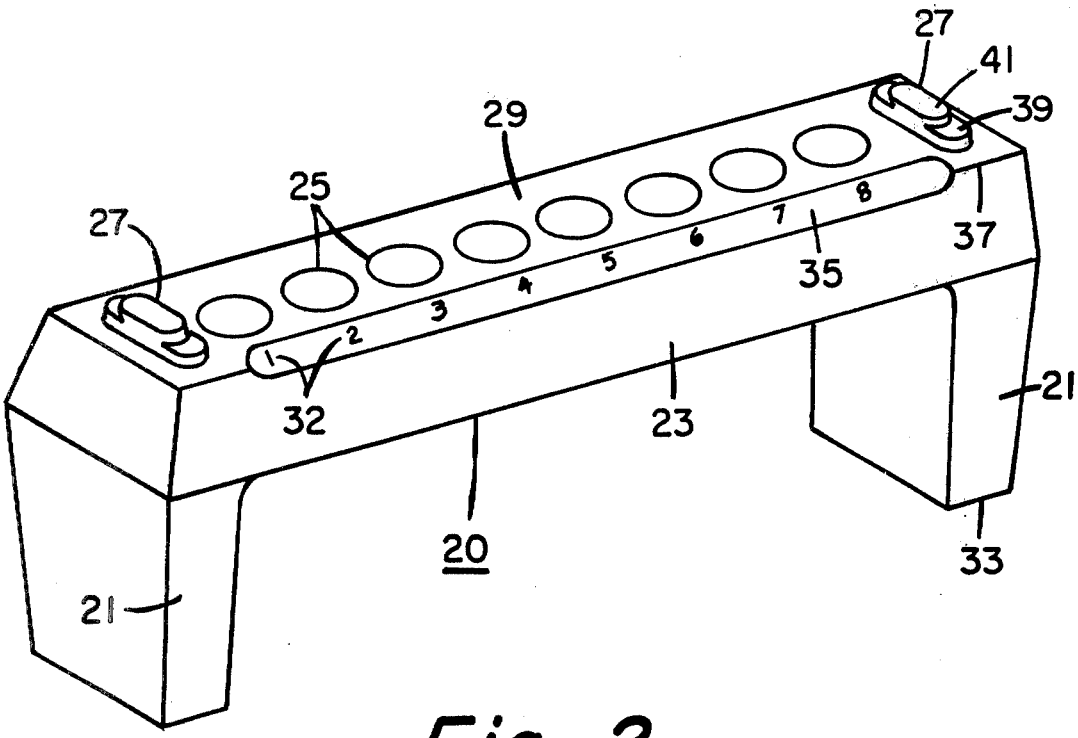
FIG. 2 is a first oblique view of a modular laboratory rack utilized in the present invention.

In FIG. 2 there is shown a modular laboratory rack (for convenience hereinafter referred to as rack 20) which is used as the main modular component of the present invention. The rack 20 is a monolithic unitary structure, which may be formed by steam chest molding of expanded polystyrene bead foam, and which includes depending legs 21 and a horizontal support member 23 joining upper portions of legs 21. The support member 23 has a plurality of through holes 25 formed therein for receiving columns and tubes as will be discussed below. Indices 32 identify each hole 25 with a position or index number (in the present invention illustrated by numbers 1 through 8). The indices 32 identify the tube or column position for the rack and may if desired serve as a part of an identification system. A face 35 is formed along upper forward edge 37 of rack 20, wherein the indices 32 are displayed. Integral lugs 27 are molded as part of upper surface 29 of support member 23. The lugs 27 have a selected profile which is used for keying and aligning one rack upon another. Recesses 31 (shown in FIG. 5*b*) are formed in lower support surfaces 33 of legs 21 and have a profile compatible with lugs 27, which will be later explained relative to the keying function mentioned above.

Figure 3:
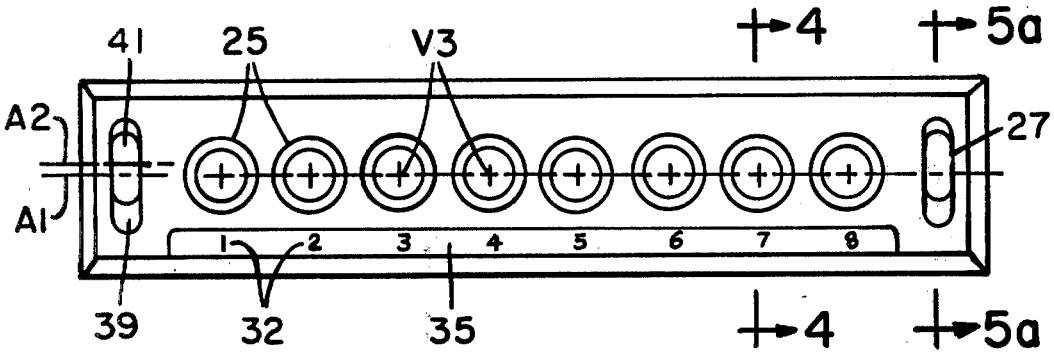
FIG. 3 is a top plan view of the laboratory rack illustrated in FIG. 2.

In FIG. 3 a top plan view of the rack 20 of the present invention is illustrated, wherein, a top profile of both the openings 25 and lugs 27 are featured in a horizontal plane.

First reference will be made to lugs 27, having respective lower and upper bosses 39 and 41. The lower boss 39 is symmetrical about a central longitudinal axis A1 which also serves as a centerline for the holes 25. The upper boss 41 is displaced rearward relative to the boss 39 and is symmetrical relative to another longitudinal axis A2. Axes A1 and A2 are normally oriented in horizontally offset vertical planes which are parallel to each other.

Figure 5B:
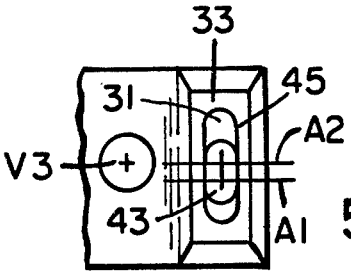
FIG. 5*b* is a fragmental bottom plan view of one leg of the laboratory rack illustrated in FIG. 2.
Figure 5A:
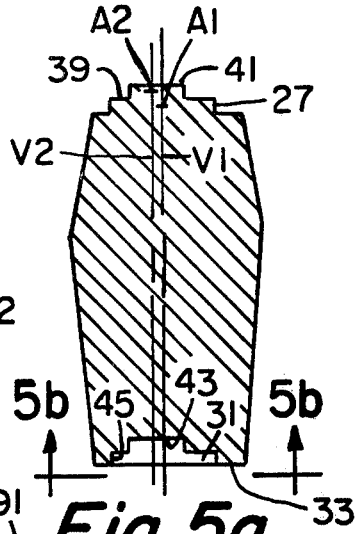
FIG. 5*a* is another side sectional elevation of the laboratory rack taken along line 5—5 of FIG. 3.

In FIGS. 5*a* and 5*b* it is apparent that lugs 27 mate in recess 31 which is shaped and located so as to key and align any one rack 20 over another in a stackable configuration. Recess 31 has a deeper or inner portion 43 which mates with upper boss 41. The inner portion 43 is axially aligned with upper boss 41 along vertical axis V2. Similarly a shallower or outer portion 45 of recess 31 is located axially in line with lower boss 39 along vertical axis V1. The axes V1 and V2 are perpendicular to and lie in the same horizontally offset vertical plane as the respective axes A1 and A2. Each respective inner and outer portion 43 and 45 of recess 31 has an axis A2' and A1' which are respectively perpendicular to axes V2 and V1 and parallel to axes A2 and A1. When two racks 20 are mated, the axes A1 and A2 of lugs 27 correspond to axes A1' and A2' of the recesses 31 into which lugs 27 mate.

Figure 4:
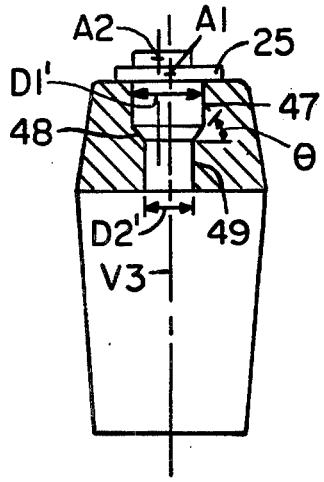
FIG. 4 is a side sectional elevation of the laboratory rack taken along line 4—4 of FIG. 3.

FIG. 4 illustrates in vertical side cross section the profile of through holes 25, which holes are adapted to receive columns and tubes described below. Each hole 25 is a formed stepped opening in support member 29 having respective upper and lower portions 47 and 49 and a tapered connecting mid section 48. The through holes 25 are located in alignment with indices 32 and preferably are formed with a vertical central axis V3. In the preferred embodiment axes V3 lie in the same vertical plane as axes V1 and A1, however, axes V3 are parallel to the former and perpendicular to the latter.

Figure 6A:
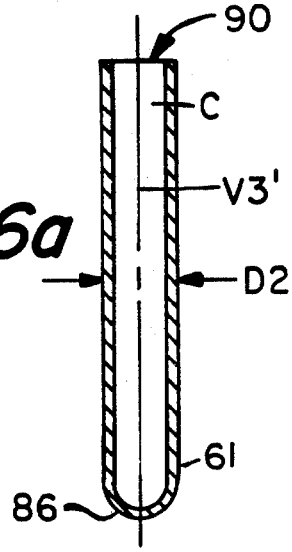
FIGS. 6*a* and 6*b* are respective side sectional elevations of a typical collection tube and fraction column utilized in the present invention.
Figure 6B:
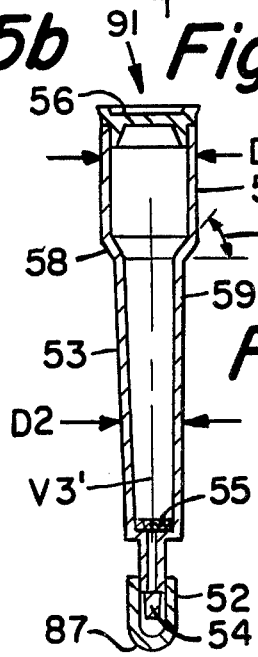

The typical column 53, illustrated in FIG. 6*b*, having a vertical central axis V3' is received in the hole 25 and has a cross section profile which mates with hole 25. Upper section 57 of column 53 has a diameter D1 corresponding closely with the diameter D1' of upper portion 47 of hole 25. Lower section 59 of column 53 has a diameter D2 which corresponds closely to the diameter D2' of lower portion 49 of hole 25, and midsection 58 of column 53 is tapered at an angle of repose closely corresponding the angle of repose of midsection 48 of the hole 25.

In FIG. 6*a* collection tube 61 is illustrated, may be snugly fit into the lower portion 49 of through hole 25. The tube 61 has a substantially uniform outer diameter D2 corresponding closely to that diameter D2' of lower portion 49 of the hole 25. The tube 61 also has a vertical central axes V3' colinear with the axes V3 of the holes 25 when the respective tube 61 is inserted therein.

Each column 53 has an upper closure or cap 56 and a lower closure. The lower closure may include a cap 52 as featured and/or may simply be a molded integral plug 54. The column 53 also includes a support media 55 which may be a glass fiber-like button of known design. The media may have reagent deposited thereon to react with whatever reagent is delivered into the column.

Figure 7A:
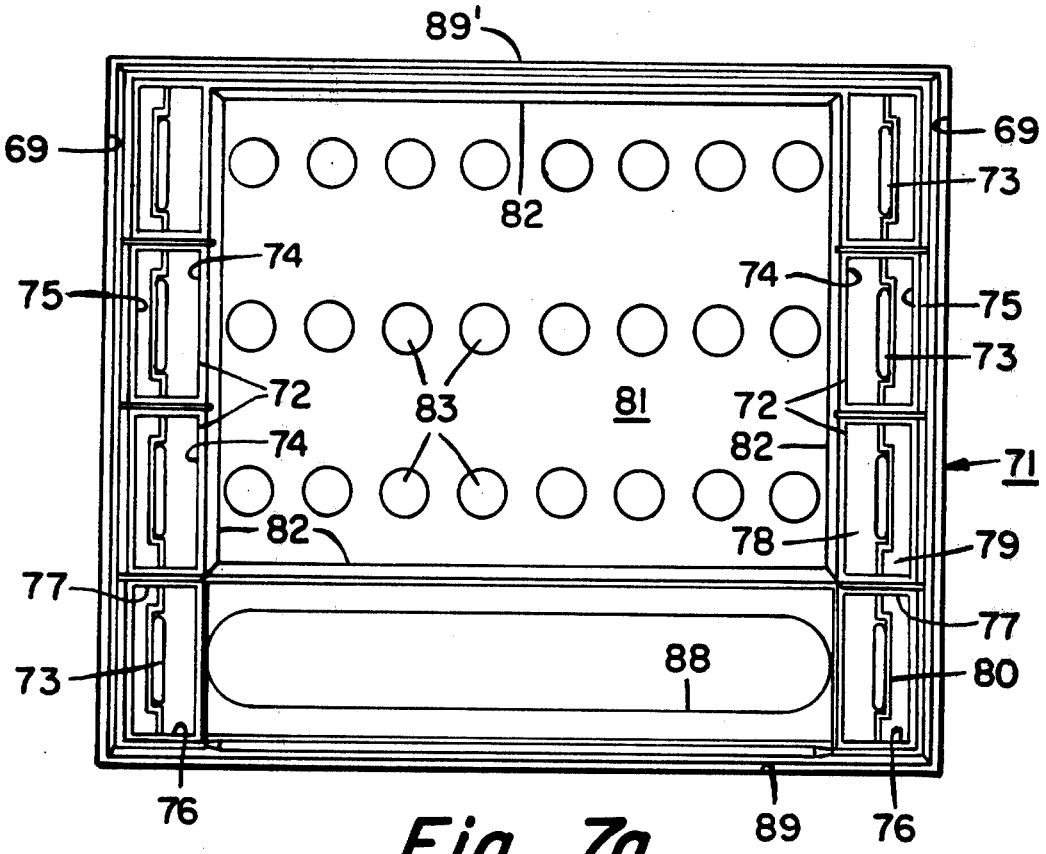
FIGS. 7*a*, 7*b* and 7*c* are respective top plan, and side and front elevations of a tray structure.
Figure 7B:
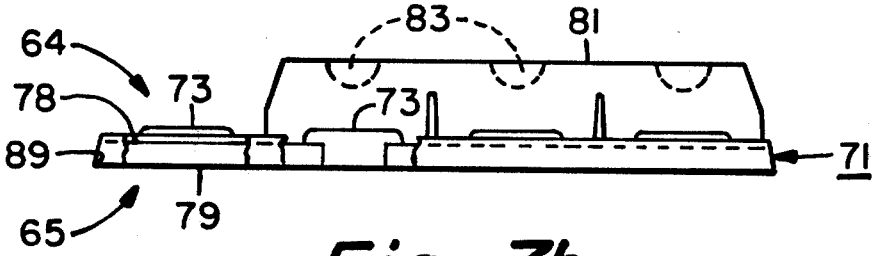
Figure 7C:
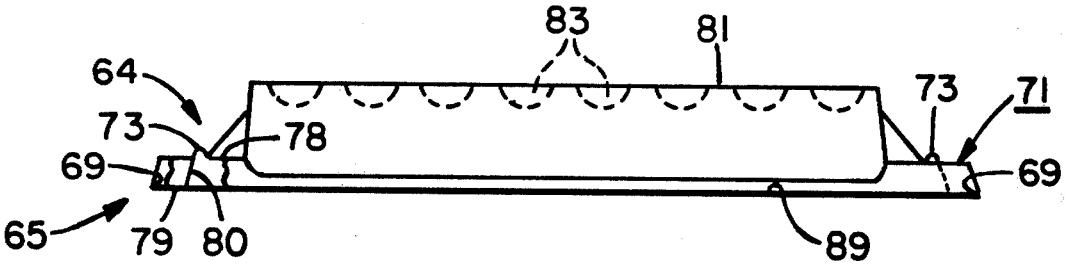

Reference is now directed to FIGS. 7*a*, 7*b* and 7*c* wherein there is shown in respective top, side and front views, a typical tray structure 71, portions of which are fragmented for illustrative purposes.

Tray structure 71 is adapted to secure a plurality of the racks 20 in a modular arrangement. The tray has a plurality of formed surfaces, the location description and function of which will be specified below. The formed surfaces may be molded or blister-formed in respective upper and lower facing surfaces of tray 71. Said upper and lower facing surfaces are illustrated by respective directional arrows 64 and 65 in FIGS. 7*b* and 7*c*. The surfaces may be made by pressing opposed mating dies against respective upper and lower facing surfaces 64 and 65 of a sheet or film of thermoplastic material. The resulting article, namely tray 71, will have its formed surfaces in a relatively thin sheet of structurally rigid formed material. Further, as will be understood by one skilled in the art an outward protruding portion of tray 71 in the upward facing side 64 will appear as an inward recess portion in the downward facing side 65. This concept will prove useful in appreciating the modular nature of the structure of the present invention as well as the self-packaging nesting features to be described later herein.

In FIG. 7*a* the top view of tray 71 shows lateral recesses 72 which are aligned adjacent opposed left and right lateral margins 69. The recess each 72 receive the lower portion of one leg 21 of a rack 20. The recesses 72 each have an upwardly protruding lug portion 73 which is adapted to mate with outer portion 45 of recess 31 in lower support surface 33 of leg 21 (see FIGS. 5*a*+8*c*). The recesses 72 each have respective inner and outer lateral wall portions 74 and 75 and respective forward and rearward transverse wall portions 76–77. The so mentioned wall portions 74–77 are adapted to retain the lower portion of the leg 21 of rack 25 securely therein snugly. (See also FIGS. 8*b*–8*c* and 9*b*.) Recess 72 also includes respective formed upper and lower support surfaces 78 and 79 separated by upstanding wall section 80. The upper support surfaces 78 are adapted to be in contact with an inner portion 33' of lower support surface 33 of leg portion 21 of the rack 20 as illustrated in detail in FIG. 8*c*. The details briefly referred to here will be more fully discussed later in the specification relative to other features and aspects of the present invention.

In FIGS. 7*a*–*c* there is also illustrated a platform area 81 bound by peripheral wall portions 82. The main platform 81 projects upward and has downwardly projecting hemispherical recesses 83 which are adapted to receive respective lowermost ends 86–87 of tubes 61 and columns 53.

The tray 71 also has an elongated opening 88 located adjacent a forward transverse margin 89. The elongated opening 88 is adapted to allow clearance for respective upper portions 90–91 of tubes 61 and columns 53, as will be explained below with reference to FIG. 8*c*.

The tray 71 is bound about its periphery by the aforementioned opposite lateral margins 69, front transverse margin 89, and a rear transverse margin 89'. Since the tray 71 is a moulded unitary structure the peripheral wall portions for recesses 72 (e.g. wall portions 74–75 platform portion 81 and upper and lower support surfaces 78–79 etc.) are joined at respective boundary lines by adjacent moulded surfaces. It should be clear to those skilled in the art that the main structural elements of the tray 71 have been described above.

Figure 8A:
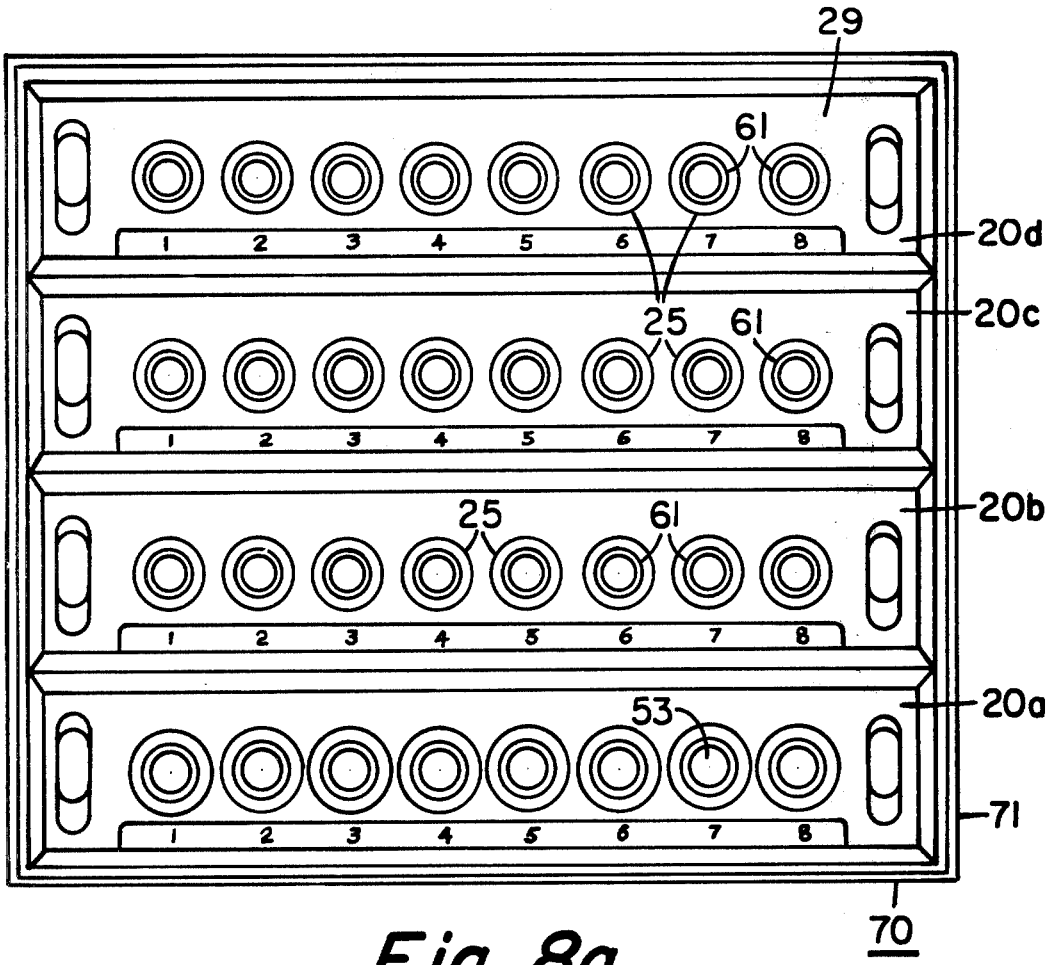
FIGS. 8*a*–8*b* are respective top and front views of a stack of modules of the present invention.
Figure 8B:
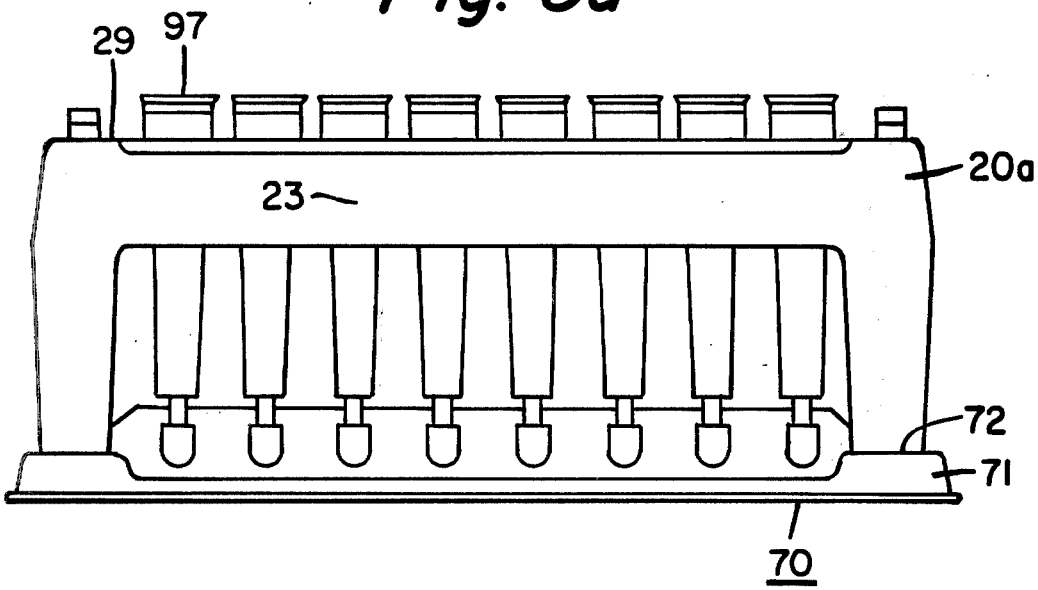
Figure 8C:
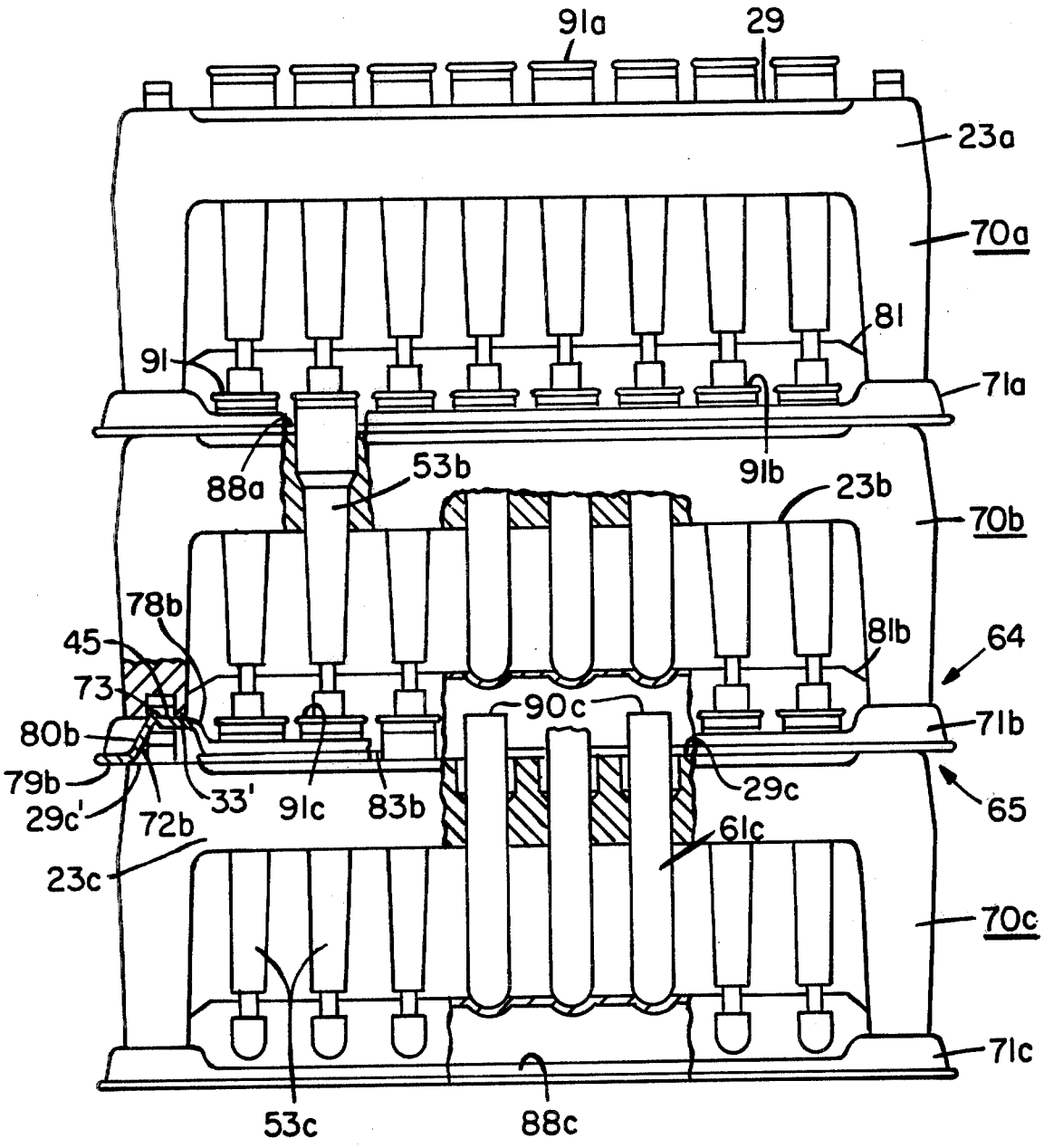
FIG. 8*c* is a front fragmented view of laboratory racks and trays as stacked for storage or shipping.

FIGS. 8a–8b illustrate a feature of the present invention that, a group of racks 20a–d and a tray 71 may be arranged as a modular unit or module 70. In FIG. 8c a stack of such modules 70a–c are illustrated. Specific portions thereof will be referenced by numerals alone or with reference to its position if important by post scripts a, b, c . . .

Modules 70 include a plurality of racks 25a–d arranged in tandem as illustrated. Each rack 20 being received in and held adjacent one another in recesses 72 (see FIGS. 7a–c and 8c) in tray 71. In the arrangement referred to above, the forward most rack 20a has, disposed in holes 25, a number of columns 53 of the type illustrated in FIG. 6b. Racks 20b–d have disposed in holes 25 tubes 61 of the type illustrated in FIG. 6a.

The racks 20 receive columns 53 or tubes 61 in holes 25 as a set of eight, as featured. The rack 20 is not limited to a particular member of holes 25, but eight is preferred for this embodiment.

The modular package 70c illustrated in FIG. 8c shows respective upper portions 90–91 of tubes 61 and columns 53 protruding from upper surface 29 of support members 23 of each of the racks 20a through 20d. The slot 88 and platform 81 of each tray 71 are adapted to allow for such protrusion from a respective lower module, so that lower support surface 79 of each tray 71 may rest on the outer upper surface 29 of an immediate lower rack 20 of each module 70.

In FIG. 8c the stacking and nesting of respective upper and lower modules 70a–70c are detailed. Note that outer upper surface 29c' of support member 23c carries lower support surface 79b in under side of recess 72b of tray 71b. Upper portions 90c of the tubes 61c of the lower module 70c are received in the under side of platform 81b, and upper end 91c of columns 53c are received through slot 88b of tray 71b.

Consequently each tray 71a–71c is arranged such that the slot 88a–c and platform 81a–c allow for the protrusion of respective upper ends 90–91 of respective tubes 61 and columns 53 from upper surfaces 29 of support members 23, thereby permitting each module 70 to stackably engage with an upper module as illustrated. It should be realized that each modular unit 70a–c, may be stacked vertically and turned 180 degrees in the horizontal relative to the other. As illustrated in the preferred embodiment however the tubes 61 and column 53 are aligned one over the other directly. Other arrangements are possible, for example flush mounted tubes or short fraction columns. The present arrangement however, has proved useful and convenient for laboratory work with attendant accuracy and reduced spillage, which justifies the more complex design of the tray. It should be understood that an important purpose of the tray is for stacking purposes and for joining one group of racks together to form a modular pact. It may be possible to eliminate the necessity of the tray completely by joining the racks 20 together by some other convenient device. The modular units 70, as described herein however, are preferred as they are easy to manipulate, relatively simple to manufacture and accomplish the desired results.

There has been described herein, a self-packaged structure for use as a test kit, which includes, modular laboratory racks which receive tubes and columns in appropriately sized openings therein, and a tray member which is adapted to secure a number of such racks together to form a modular package. The modular package is stackable over similarly formed packages and the modules form a ready-to-use laboratory test kit upon removal from an appropriate shipping carton.

In FIGS. 9a–9b the kit concept in operation is clearly featured with portions of the drawing fragmented for simplifying the illustration. Rack 20a holding columns 53 is manually lifted out of the tray 71, and each column is identified by column identification tag 53'. Thereafter upper closures 56 (see FIG. 6b) are removed and the lower plug closures 54' and/or caps 54 are opened to release buffer solution therein. As mentioned earlier, the buffer prolongs shelf life and protects support media 52.

The buffer solution is permitted to drain in a towel or the like (not shown) under tray 71 through slot 89. Thereafter the tubes 61 and racks 20b–c etc. are identified with tags 61' and returned to the tray 71 in appropriate positions. The rack 20a is again removed from the tray 71 and placed in a keying relationship with the first rack rearward thereof namely rack 20b for a first series of tests. A pipette 95 delivers chemical or bio-chemical reagent 96 to each column 53. Note that the index numbers 1 to 8 for each rack 20a and *b* are facing forward. This is due to the keying feature of the lugs 27 and recesses 31 explained previously. A reversal of rack 20a relative to rack 20b-etc. would mix the tests and invalidate the results. The key alignment feature plus visual observation of the indices 32 prevents this source of error.

Modified reagent 97 is delivered to each respective tube 61 (indexed 1–8) in rack 20b via the columns 53. Lower portion of column 53 enters the upper portion 90 of the tubes 61 immediately below in rack 20b. In operation, when one modular rack 20 is stacked over another, the lower ends 87 of each column 53 will enter the upper end 90 of the tube immediately below for delivery of modified reagent 97 thereby reducing spillage and inaccurate measurement. After a first series of tests the rack 20a is thereafter located into the next succeeding rack namely 20c for another series, and so on. It should be clear that any number of various tests can be performed and any number of sizings and spacings of columns and tubes can be fabricated to produce a selected test kit arrangement.

While there has been described, what is presently considered to be the preferred embodiment of the present invention, it will be obvious to those skilled in the art, that various changes and modifications may be made therein, without departing from the invention. It is intended, in the appended claims, to cover all such changes and modifications as fall within the true spirit and scope of the invention.

I claim:

1. A self-packaged structure for use as a test kit comprising: collection tubes and fraction columns supported in said structure in an array including: a plurality of racks each adapted for supporting the fraction columns and collection tubes and a tray adapted to receive a plurality of said racks therein in a vertical orientation and to securely support one rack adjacent to another in tandem to form a modular package; each of said racks comprising: a modular integral monolith including: dependent legs, and a horizontal support member joining upper portions of the legs, the support member having a plurality of through holes therein aligned adjacent one another between the legs, each hole having a shaped interior wall adapted to receive a selected one of the fraction columns and collection tubes in substantially upright fashion, upstanding lugs disposed on an upper surface of the support member and aligned with a lower horizontal support surface of the legs, the legs having complimentary recesses therein shaped for frictionally receiving the lugs of another of said racks to facilitate stacking of one rack over another, each tray including first means adapted for receiving at least one rack securing fraction columns therein and second means adapted for receiving at least one rack securing collection tubes therein, portions of the first and second means being spaced in said tray to mate with the lower horizontal support surface of the legs and further including, respective first and second surfaces aligned in selected spaced relation with the support member for the respective rack for supporting the fraction columns and collection tubes.

2. The self-packaged structure of claim 1 wherein, the lugs and complimentary recesses are keyed so as to permit one correct alignment of tubes and columns disposed in each rack.

3. The self-packaged structure of claim 1 further including: index means formed in a forward front surface of each of said racks for indicating respective positions for each through hole, and each index means for one rack is aligned with a respective index means for another of said racks to indicate correct alignment of columns and tubes adapted to be located in said through holes.

4. The self-packaged structure of claim 1 wherein the shaped interior wall of each through hole is formed with a stepped concentric diameter to receive the columns and tubes in accordance with respective outer diameters thereof.

5. The self-packaged structure of claim 1 wherein, the through holes are vertically and axially aligned in the support member and include an upper portion of selected diameter, a lower portion of selected diameter somewhat smaller than said upper portion and a tapered mid section joining said upper and lower portions.

6. The self-packaged structure of claim 1 wherein the lugs comprise: elongated stepped upper and lower bosses formed in the upper surface of the support member, the lower one of each boss being of a selected length and the upper one of each boss being of somewhat shorter length, said upper boss being lengthwise off center in the same direction relative to the lower boss and the respective complimentary recesses for each stepped boss being disposed in lower support surfaces of the legs in vertical and axial alignment with the lugs, each recess having a stepped mating profile such that, only one alignment of the lugs and recesses is correct for stacking the racks.

7. The self-packaged structure of claim 1 wherein the first and second means adapted to receive the respective fraction column and collection tube containing racks adjacent each other comprises: spaced recesses aligned adjacent opposed lateral margins of the tray for receiving at least a portion of lower support surfaces of the legs of the respective racks.

8. The self-packaged structure of claim 7 wherein the tray has at least two pair of said spaced recesses, forming with said racks a stackable module.

9. The self-packaged structure of claim 8 wherein each of said recesses includes an upper and lower support surface, said upper support surface engaging with said portion of the leg of the rack and the lower support surface engaging with a portion of the upper support surface of said support member.

10. The self-packaged structure of claim 1 wherein, said first surface of the tray has at least one elongated opening disposed between a pair of the spaced recesses for the fraction column containing rack.

11. The self-packaged structure of claim 1 wherein, the second surface of the tray includes a platform recess disposed between at least one pair of the spaced recesses for the collection tube containing rack, the platform recess for receiving upper portions of collection tubes and fraction columns thereunder when one modular package is stacked on another.

12. The self-packaged structure of claim 11 wherein the platform recess comprises an elevated platform portion formed in the tray and which platform recess has minor recesses formed therein for receiving and supporting lower portions of at least one of the collection tubes and fraction columns.

13. The self-packaged structure of claim 12 wherein the spaced recesses, platform recess and elongated slot of the tray are sized and spaced for stacking of one modular package in vertical nesting relation with another modular package.

14. The self-packaged structure of claim 1 wherein the sizing and spacing of the first and second surfaces of each tray is adapted for stacking of successive modular packages rotated by 180° relative to each other in the horizontal.

15. The self-packaged structure of claim 1 wherein the fraction columns are adapted to receive a delivered reagent through an upper inlet opening and release a modified reagent through a lower outlet opening and means disposed within said fraction column effects flow of said delivered reagent therethrough and modifies same.

16. The self-packaged structure of claim 15 wherein said means disposed in said fraction column comprises a media support member in the form of a glass fiber-like button.

17. The self-packaged structure of claim 15 wherein said upper inlet and lower outlet of said fraction column includes removable closure means.

18. The self-packaged structure of claim 17 wherein said removable closure means includes upper and lower caps fractionally engaging with respective inlet and outlet openings.

19. The self-packaged structure of claim 17 wherein said lower outlet closure means is an integrally formed blockage for the outlet, said blockage being manually removable by cutting to render said lower outlet operative.

20. The self-packaged structure of claim 15 wherein said fraction columns are disposed in the openings of at least one rack, collection tubes are disposed in the openings of another rack and in operation, the fraction column containing rack is disposed over the collection tube containing rack with outlets of each of the fraction columns disposed in an upper opening of a corresponding collection tube for collecting modified reagent from said fraction column.

21. The self-packaged structure of claim 20 wherein means is provided for identifying each collection tube and fraction column for orderly arrangement thereof.

22. A self-packaged structure for use as a test kit comprising collection tubes and fraction columns adapted to be supported in said structure in any array including: a plurality of racks each adapted for supporting fraction columns and collection tubes and tray means adapted for securing one rack adjacent to another in tandem to form a modular package; each of said racks comprising: a modular integral monolith including: dependent legs, and a horizontal support member joining upper portions of the legs, the support member having a plurality of through holes therein aligned adjacent one another between the legs, the holes adapted to receive the columns and tubes in substantially upright fashion, upstanding lugs disposed on an upper surface of the support member and aligned with a lower horizontal support surface of the legs, the legs having complimentary recesses therein shaped for frictionally receiving the lugs of another of said racks to facilitate stacking of one rack over another; said tray means including spaced pairs of lateral recesses arranged in tandem for receiving portions of the legs of the racks, and means located between at least one pair of the lateral recesses in selected spaced relation with the support surface of a rack received in the lateral recesses for allowing only a rack containing tubes therein to be located in said recesses; elongated stepped upper and lower bosses formed in the upper surface of the support member, the lower one of each boss being of a selected length and the upper one of each boss being of somewhat shorter length, said upper boss being lengthwise off center in the same direction relative to the lower boss and the respective complimentary recesses for each stepped boss being disposed in lower support surfaces of the legs in vertical and axial alignment with the lugs, each recess having a stepped mating profile such that, only one alignment of the lugs and recesses is correct for stacking the racks.

* * * * *

UNITED STATES PATENT AND TRADEMARK OFFICE

CERTIFICATE OF CORRECTION

PATENT NO. : 4,160,803

DATED : July 10, 1979

INVENTOR(S) : Robert S. Potts

It is certified that error appears in the above-identified patent and that said Letters Patent are hereby corrected as shown below:

The title "SELF PACKAGED TEST KIT" should be changed to read --SELF-PACKAGED STRUCTURE FOR A TEST KIT; under "ABSTRACT", first line, "A self-packaged structure" should be changed to read --There has been provided a self-packaged structure--; column 8, line 68, "any" should be changed to read --an--.

Signed and Sealed this

*First* Day of *April 1980*

[SEAL]

*Attest:*

SIDNEY A. DIAMOND

*Attesting Officer*

*Commissioner of Patents and Trademarks*